US010208619B2

(12) United States Patent
Jones et al.

(10) Patent No.: US 10,208,619 B2
(45) Date of Patent: Feb. 19, 2019

(54) VARIABLE LOW TURBINE VANE WITH AFT ROTATION AXIS

(71) Applicants: Russell B Jones, North Palm Beach, FL (US); Barry J Brown, Jupiter, FL (US); Stephen E Murray, Port St. Lucie, FL (US)

(72) Inventors: Russell B Jones, North Palm Beach, FL (US); Barry J Brown, Jupiter, FL (US); Stephen E Murray, Port St. Lucie, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 290 days.

(21) Appl. No.: 15/174,051

(22) Filed: Jun. 6, 2016

(65) Prior Publication Data

US 2017/0234152 A1 Aug. 17, 2017

Related U.S. Application Data

(60) Provisional application No. 62/249,598, filed on Nov. 2, 2015.

(51) Int. Cl.
*F01D 17/16* (2006.01)

(52) U.S. Cl.
CPC ..... *F01D 17/162* (2013.01)

(58) Field of Classification Search
CPC ..... F01D 17/162; F01D 9/041; F01D 17/14; F01D 17/16; F05D 2220/32; F04D 29/563
See application file for complete search history.

(56) References Cited

U.S. PATENT DOCUMENTS

| | | | | |
|---|---|---|---|---|
| 3,295,827 | A * | 1/1967 | Chapman | F01D 5/148 415/156 |
| 4,150,915 | A | 4/1979 | Karstensen | |
| 4,314,791 | A | 2/1982 | Weiler | |
| 4,861,228 | A | 8/1989 | Todman | |
| 4,950,129 | A * | 8/1990 | Patel | F01D 5/26 415/148 |
| 5,039,277 | A | 8/1991 | Naudet | |
| 5,517,817 | A | 5/1996 | Hines | |
| 5,931,636 | A | 8/1999 | Savage et al. | |
| 6,179,559 | B1 | 1/2001 | Weaver | |
| 6,481,960 | B2 | 11/2002 | Bowen | |
| 6,843,638 | B2 | 1/2005 | Hidalgo et al. | |
| 6,984,105 | B2 | 1/2006 | Clark et al. | |
| 7,125,222 | B2 | 10/2006 | Cornier et al. | |
| 7,264,441 | B2 | 9/2007 | Loudet | |
| 7,713,022 | B2 | 5/2010 | Major et al. | |
| 7,806,652 | B2 | 10/2010 | Major et al. | |

(Continued)

FOREIGN PATENT DOCUMENTS

GB 1112058 A * 5/1968 ..... F01D 5/148

*Primary Examiner* — Eldon T Brockman
(74) *Attorney, Agent, or Firm* — John Ryznic

(57) ABSTRACT

A turbine with a variable inlet guide vane assembly in which the vane airfoils extend between inner and outer buttons, and in which a center of rotation of the airfoil is located aft of an aerodynamic center of pressure of the airfoil. The trailing edge of the airfoil extends into both of the buttons such that no gap is formed between the airfoil trailing edge region and a static part of the turbine during movement of the airfoil from an opened position to a closed position.

6 Claims, 4 Drawing Sheets

(56) References Cited

U.S. PATENT DOCUMENTS

| | | | | |
|---|---|---|---|---|
| 7,985,053 | B2 * | 7/2011 | Schott | F01D 9/04 416/223 A |
| 8,186,963 | B2 * | 5/2012 | LaMaster | F01D 5/141 416/223 A |
| 8,202,043 | B2 | 6/2012 | McCaffrey | |
| 8,517,661 | B2 | 8/2013 | Schilling | |
| 8,651,803 | B2 | 2/2014 | Jones et al. | |
| 8,734,088 | B2 | 5/2014 | Jones et al. | |
| 9,062,560 | B2 * | 6/2015 | Hayford | F01D 17/162 |
| 2012/0263571 | A1 * | 10/2012 | Ress, Jr. | F01D 17/162 415/1 |
| 2013/0243580 | A1 * | 9/2013 | Hayford | F01D 17/162 415/160 |

* cited by examiner

VARIABLE LOW TURBINE VANE WITH AFT ROTATION AXIS

CROSS-REFERENCE TO RELATED APPLICATIONS

This application claims the benefit to U.S. Provisional Application 62/249,598 filed on Nov. 2, 2015 and entitled VARIABLE LOW TURBINE VANE WITH AFT ROTATION AXIS.

GOVERNMENT LICENSE RIGHTS

This invention was made with Government support under contract number DE-FE0023975 awarded by Department of Energy. The Government has certain rights in the invention.

BACKGROUND OF THE INVENTION

Field of the Invention

The present invention relates generally to a gas turbine engine, and more specifically to an industrial gas turbine engine with a second spool having a variable inlet guide vane assembly for the low pressure turbine.

Description of the Related Art Including Information Disclosed Under 37 CFR 1.97 and 1.98

Variable angle vanes are used to vary the mass flow through compressor and turbine passages. Compared to fixed airfoils that have integral outer and inner end walls, variable vanes have leakage areas between the airfoil and the end walls. These leakage paths create undesirable aerodynamic losses. The larger the desired swing angle of the airfoil, the bigger the challenge to minimize these gaps. The cycle benefit for having an adjustable vane throat greatly outweighs the leakage debits.

Variable inlet guide vanes are used in both a compressor and a turbine. However, the structure for a turbine variable inlet guide vane is different than for the compressor variable inlet guide vane. In a compressor, the flow path is decreasing in height as the compressed air passing through the stages of the compressor increases in pressure. Thus, the radial or spanwise height of the trailing edge of the vane decreases in the flow direction of the compressed air. This is the opposite in a turbine where the compressed gas is increasing or expanding in the flow direction. Thus, in a turbine the spanwise height of the vane at the trailing edge is increasing in height. Thus, the leakage across the ends of the vane at the trailing edge will have greater areas due to this structure.

In addition to controlling the gaps, aerodynamic forces acting on the airfoil are considered to select the optimum rotation axis. The airfoil center of pressure is the location where the moments are zero. The rotation axis placed through the center of pressure yields no additional forces over friction to articulate the vane. This center of pressure can vary on position when the stagger angle of the airfoil is changed.

BRIEF SUMMARY OF THE INVENTION

A turbine variable inlet guide vane assembly for a gas turbine engine, such as an industrial gas turbine engine having a low pressure turbine, where the variable inlet guide vane assembly includes guide vanes having airfoils that extend between large diameter outer and inner buttons in which the airfoil trailing edge extends into the two buttons so that no gap is formed. The airfoil has a center of rotation that is located aft or downstream from an aerodynamic center of pressure which will decrease any gap from forming in the movement of the airfoil from an open position to a closed position and thus increase a performance of the turbine. For a given leakage gap, leakage flow amount and performance loss per unit flow is larger at aft portion of turbine airfoil due to high airfoil velocities than in front portion.

DETAILED DESCRIPTION OF THE INVENTION

The present invention is a variable inlet guide vane for a turbine in which a rotational axis of the airfoil is located aft of the aerodynamic center of pressure on the airfoil in order to eliminate leakage gaps at the two endwalls. This is done to articulate the turbine vane at the entrance of a low pressure turbine on an axis well aft of the aerodynamic center of pressure. The use of this aft places rotation axis in combination with large diameter end wall buttons, minimized the clearance gaps of the OD and ID interface of the airfoil to end walls. By placing rotation center aft of the aerodynamic center of pressure leakage gap over aft portion of airfoil is minimized. For a given leakage gap, leakage flow amount and performance loss per unit flow is larger at aft portion of turbine airfoil due to high airfoil velocities than in front portion.

The rotation axis centered aft of airfoil's aerodynamic center of pressure creates forces on the vane that makes the system inherently want to close, that is seen as a negative system function. The benefit of minimizing the airfoil to end wall gaps creates a performance improvement over todays state of the art (Axis forward of the center of pressure). Additional safeties on the sync ring system that is driven to articulate the vane stems would ensure that the actuator force will have full command to position the vanes at the desired angle.

Figure 1:
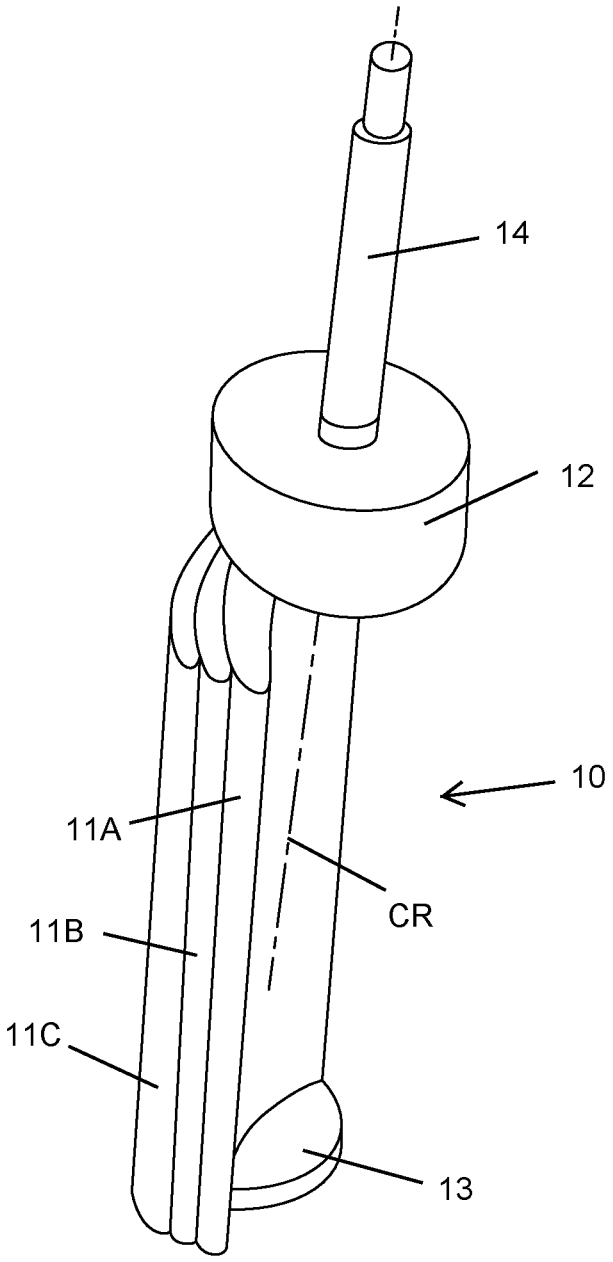
FIG. 1 shows an isometric view of a variable vane with the rotational axis behind the airfoil center of pressure with the vane is three different positions according to the present invention.
Figure 2:
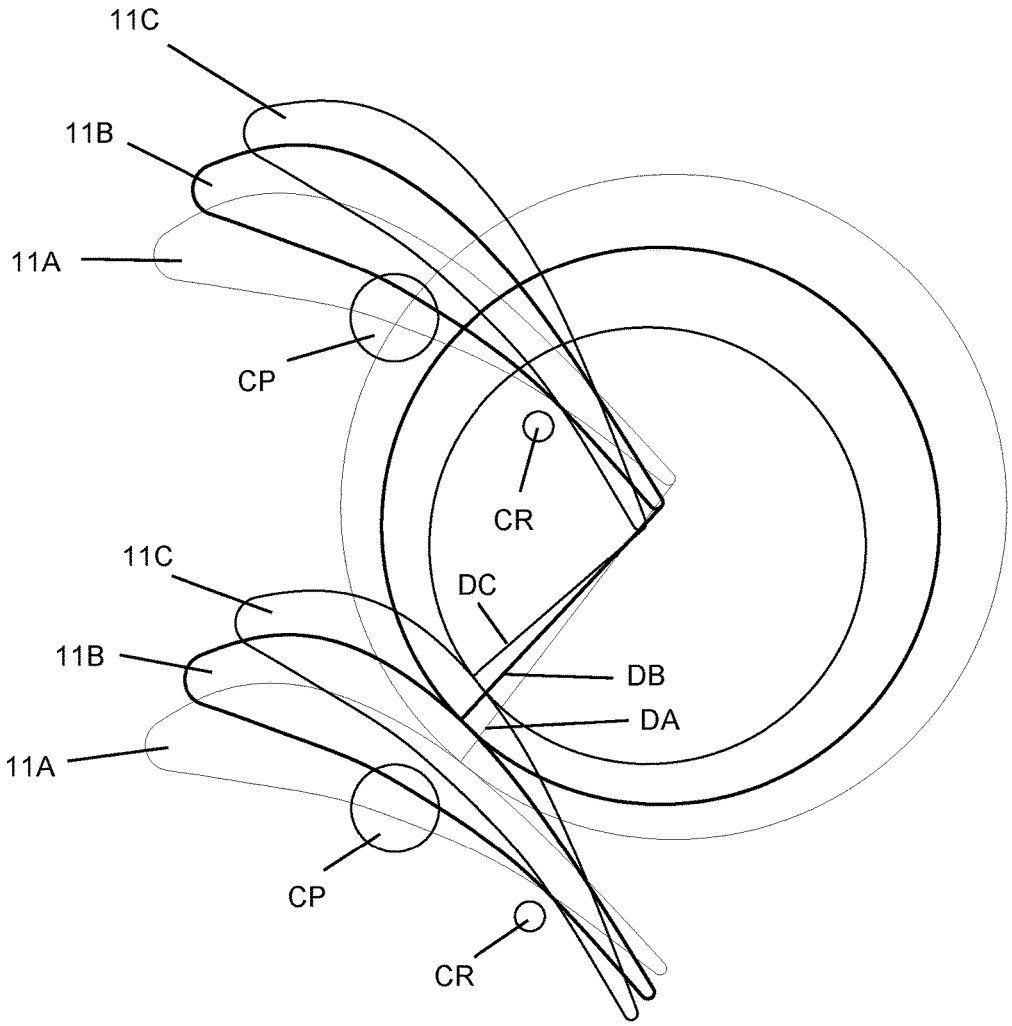
FIG. 2 shows a top view of two adjacent variable guide vanes in the open airfoil position, the nominal airfoil position, and the closed airfoil position of the present invention.
Figure 3:
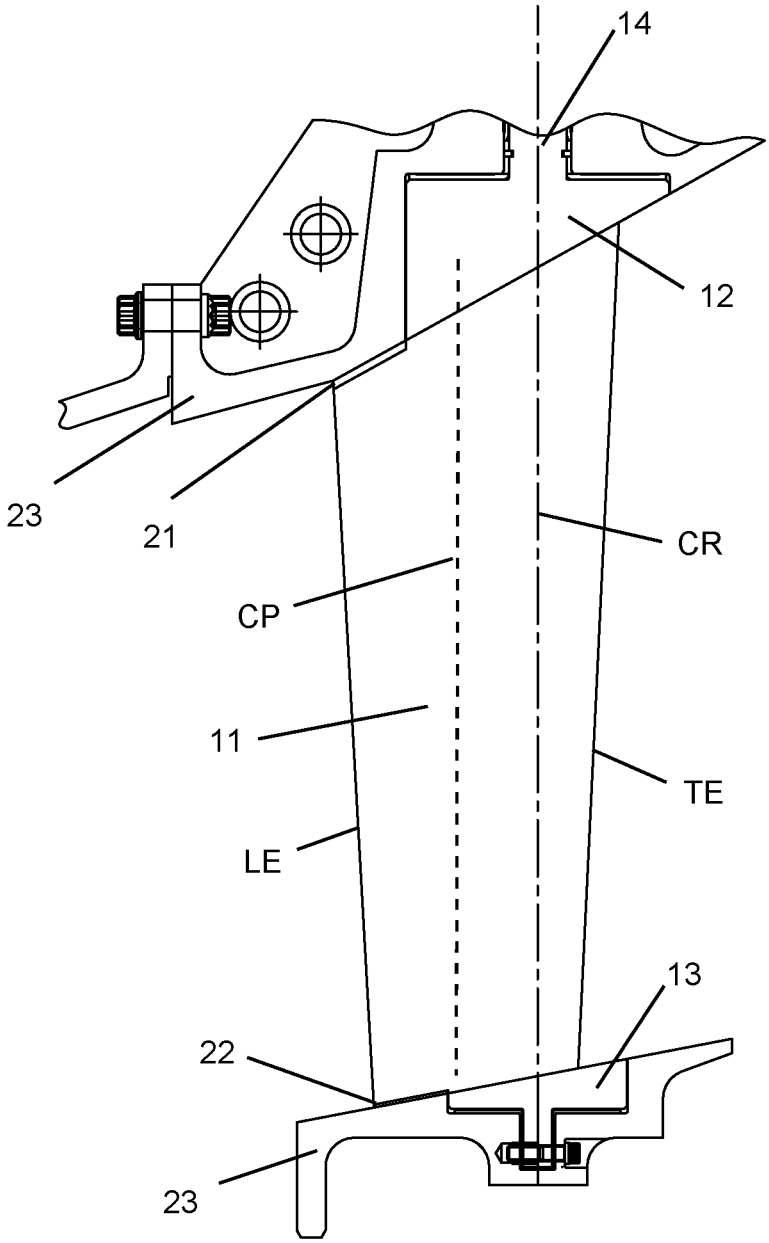
FIG. 3 shows a side view of the turbine variable inlet guide vane with the outer diameter and the inner diameter gaps between the endwalls according to the present invention.

FIG. 1 shows an isometric view of a variable guide vane with the rotation axis behind the airfoil center of pressure. FIG. 2 show a mid-span section of the airfoils in FIG. 1 with circle radius indicating the throat area change as the vane angle is articulated about the selected vane rotation axis. FIG. 3 shows the outer diameter (OD) and inner diameter (ID) gaps between the OD and ID end walls that are minimized for diverging turbine flow paths with variable guide vanes articulated with axis of rotation aft of the airfoil center of pressure.

FIG. 1 shows one of the airfoils in the variable inlet guide vane 10 for a turbine where the airfoil 11 extends between an outer button 12 and an inner button 13 with an adjustment shaft 14 extending out from the outer button 12. The two buttons 12 and 13 are relatively large diameter buttons when compared to prior art buttons. FIG. 1 shows the airfoil in one of three positions with the open airfoil position 11A at one extreme, the closed airfoil position 11C at the other extreme, and the airfoil nominal position 11B in-between. The airfoil center of rotation CR is shown as the dashed line.

FIG. 2 shows a top view of two adjacent airfoils in the turbine variable inlet guide vane assemblies with the airfoil shown in the three positions 11A, 11B and 11C. The aerodynamic center of pressure CP is shown for each of the two airfoils 11 and the center or rotation CR in FIG. 2. As seen in FIG. 2, the center of rotation of the airfoil 11 is located aft of the aerodynamic center of pressure CP. As the adjacent airfoils rotate about the CR, the spacing between adjacent airfoils changes from DA to DC where DA is the spacing between adjacent airfoils at the 11A position and DC is the spacing between adjacent airfoil at the 11C position. The spacing DB is the spacing between adjacent airfoils at the nominal position 11B. The three circles in FIG. 2 represent a circle from the trailing edge with a radius equal to the spacing between adjacent airfoils at the various three positions 11A to 11C.

FIG. 3 shows one of the airfoils 11 of the turbine variable inlet guide vane assemblies of the present invention with the upper button 12 and the lower button 13 at the two ends of the airfoil 11. The center of rotation CR is located aft of the aerodynamic center of pressure CP. Because the airfoil 11 ends at the two buttons 12 and 13, as the airfoil pivots from the open airfoil position 11A to the closed airfoil position 11C, no gap is formed between the airfoil trailing edge region and the button. As seen in FIG. 2, the airfoil trailing edge (TE) is located inward in a chordwise direction of the airfoil from the outer radius of each of the two buttons 12 and 13. This is the structure that provides for elimination of any gaps. Gaps 21 and 22 do exist in the leading edge regions of the airfoil 11 (and the gaps change from the airfoil positions 11A to 11C) because the leading edge (LE) of the airfoil 11 is located outward in the chordwise direction of the airfoil from the outer radius of the two buttons 12 and 13. Thus, because no gap is formed then no leakage can flow across any gap. Since the airfoil trailing edge height is greater than the leading edge height, and gap would be increased when the airfoil was pivoted between positions. Gap leakage flow would be more critical in a turbine than in a compressor because of the hot gas temperature in the turbine. Hot gas leakage causes performance loss as well as short life for the parts due to erosion and thermal stress issues.

Figure 4:
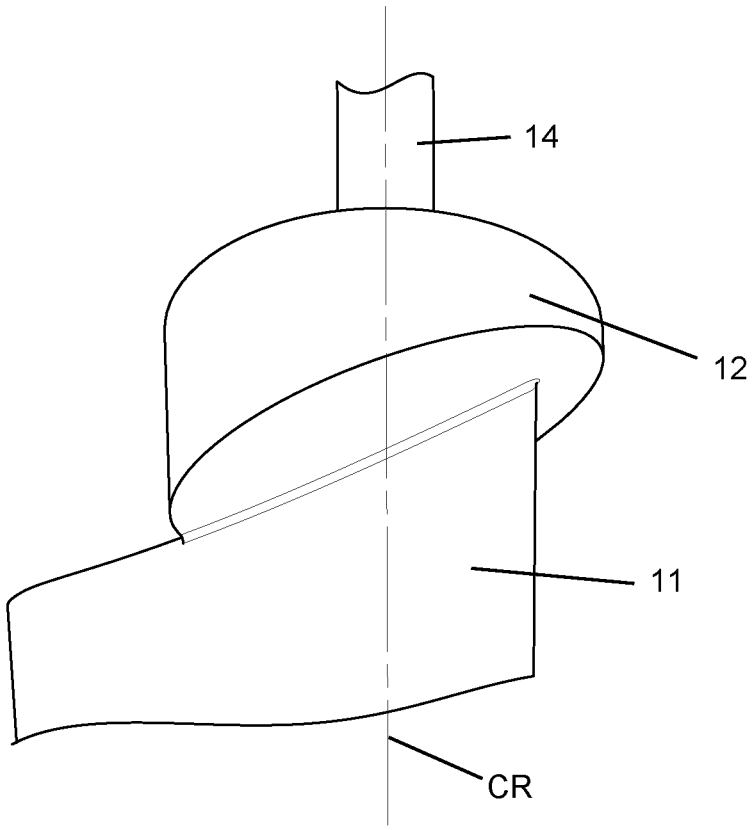
FIG. 4 shows a close-up view of the guide vane airfoil and the upper button arrangement of the present invention.
Figure 5:
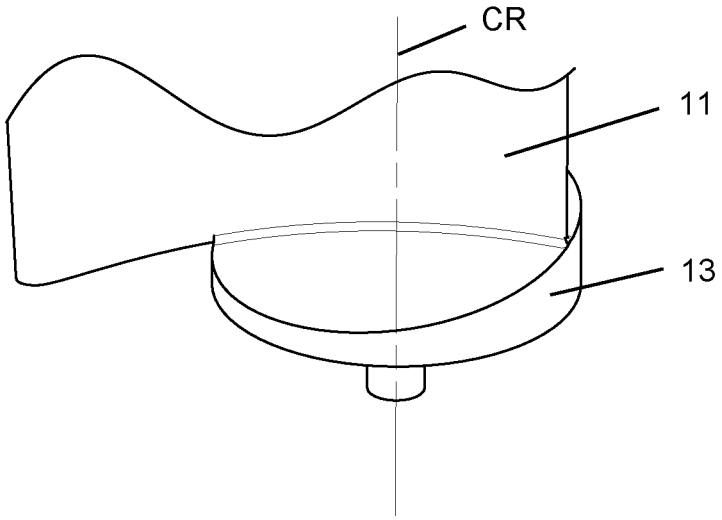
FIG. 5 shows a close-up view of the guide vane airfoil and the lower button arrangement of the present invention.

FIG. 4 shows the airfoil 11 at the upper button 12 with the airfoil extending from the button in which no gap is formed. FIG. 5 shows a similar structural arrangement between the airfoil and the lower button 13. No gap formed in the lower span either. Thus, as the airfoil pivots from the open to the closed position, no gaps are formed at the trailing edge regions in which leakage could flow.

We claim:

1. A turbine with a variable inlet guide vane assembly for a gas turbine engine comprising:

a variable inlet guide vane having a diverging flow path located upstream in a flow direction of a rotor blade of the turbine;

the variable inlet guide vane having an airfoil extending between an upper button and a lower button;

the airfoil having a leading edge and a trailing edge;

the airfoil having an aerodynamic center of pressure and a center of rotation; and, the center of rotation of the airfoil is located downstream in the flow direction of the aerodynamic center of pressure of the airfoil.

2. The turbine with a variable inlet guide vane assembly of claim 1, and further comprising:

the trailing edge of the airfoil is located inward in an airfoil chordwise direction from an outer radius of the two buttons.

3. The turbine with a variable inlet guide vane assembly of claim 1, and further comprising:

the trailing edge of the airfoil extends into each of the two buttons such that no gap is formed between the trailing edge region of the airfoil and a static structure of the turbine in which leakage can flow.

4. An airfoil for a turbine variable inlet guide vane assembly, the airfoil comprising:

an airfoil with a leading edge and a trailing edge;

the airfoil having a diverging flow path;

the airfoil having an aerodynamic center of pressure and a center of rotation;

the airfoil center of rotation being aft of the airfoil aerodynamic center of pressure;

the airfoil extending between an outer button and an inner button;

a radius of the two buttons being greater than a distance of the trailing edge of the airfoil from the center of rotation of the airfoil in a chordwise direction of the airfoil.

5. The airfoil of claim 4, and further comprising:

the radius of the two buttons is less than a distance of the leading edge of the airfoil from the center of rotation of the airfoil in a chordwise direction of the airfoil.

6. A variable inlet guide vane for a gas turbine comprising:

an airfoil with a leading edge and a trailing edge;

the airfoil extending between an upper button and a lower button;

the airfoil having a diverging flow path;

the trailing edge of the airfoil extends into the upper button and the lower button;

the airfoil having an aerodynamic center of pressure and a center of rotation; and, the center of rotation of the airfoil is located downstream in the flow direction of the aerodynamic center of pressure of the airfoil.

* * * * *